United States Patent [19]

Bormuth

[11] Patent Number: 4,941,836

[45] Date of Patent: Jul. 17, 1990

[54] CONNECTOR HOUSING WITH MOVABLE TERMINALS

[75] Inventor: Peter Bormuth, Bensheim, Fed. Rep. of Germany

[73] Assignee: AMP Incorporated, Harrisburg, Pa.

[21] Appl. No.: 320,676

[22] Filed: Mar. 8, 1989

[30] Foreign Application Priority Data

May 5, 1988 [GB] United Kingdom ..... 8810590

[51] Int. Cl.[5] ..... H01R 13/629

[52] U.S. Cl. ..... 439/247; 439/246

[58] Field of Search ..... 439/246–252, 439/687, 690, 701, 745

[56] References Cited

U.S. PATENT DOCUMENTS

| | | | |
|---|---|---|---|
| 3,065,447 | 11/1962 | Maurer | 339/184 |
| 4,220,384 | 9/1980 | Clark et al. | 339/59 |
| 4,697,859 | 10/1987 | Fisher | 439/246 |

FOREIGN PATENT DOCUMENTS

| | | | |
|---|---|---|---|
| 657903 | 5/1929 | France | 439/252 |
| 1029097 | 3/1953 | France | 439/252 |
| 2396438 | 7/1977 | France . | |
| 311178 | 9/1932 | United Kingdom | 439/252 |
| 2165401 | 9/1984 | United Kingdom . | |

OTHER PUBLICATIONS

Article entitled: "Who Says All Females Are Alike".

Standard Search Report DTD 20, Mar. 1989.

Standard Search Report Annex.

*Primary Examiner*—Eugene F. Desmond

*Attorney, Agent, or Firm*—Bruce J. Wolstoncroft

[57] ABSTRACT

An electrical connector is provided with terminals (30) that are movable relative to the connector housing (2). The terminals (30) are provided in terminal receiving housings (34) and are secured therein. The terminal receiving housings (34) are configured to receive various types of terminals therein. The terminal receiving housings (34) are provided in the electrical connector housing (2) in such a way as to prevent the removal of the terminal receiving housings (34) from the electrical connector housing (2), while still permitting the terminal receiving housings (34) to move relative to the connector housing (2). This movable mounting of the terminal receiving housings (34) in the electrical connector allows the terminal receiving housings (34) to compensate for misaligned or bent mating terminals (56) which are inserted therein. The movement of the terminal receiving housings (34) insures that the longitudinal axis of the terminals (30) provided in the terminal receiving housings (34) will align with the longitudinal axis of the mating terminals (56) when insertion occurs. This alignment prevents damage to either the terminals (30) or the mating terminals (56) and insures that a positive electrical connection will be effected.

11 Claims, 4 Drawing Sheets

2
4
6
8
10
20
22
24
26
28
30
32
34
36
38
40
42
44
46
48
49
50
52

CONNECTOR HOUSING WITH MOVABLE TERMINALS

FIELD OF THE INVENTION

The invention is directed to movable terminals secured in a connector housing. This movement insures that a positive electrical connection will be effected between the terminals and mating terminals of a mating connector.

BACKGROUND OF THE INVENTION

The mating of male and female terminals is a commonplace occurrence. This type of mating is an easy, cost effective way of providing a means to make an electrical connection between various electrical components. However, this interconnection between the male and female terminals can be unreliable, thereby causing the failure of an entire connector.

The unreliability of the electrical connection between the terminals occurs for several reasons. When terminals are provided in connector housings, the spacing of the connectors is not always accurately controlled. In particular, the cumulative manufacturing tolerance of the terminals can cause problems when respective connectors are mated together, i.e., the centerline of a respective terminal may not coincide with the center line of the mating terminal due to the tolerances of manufacture. Therefore, as the terminals are mated together, it is conceivable that the misalignment, due to the cumulative tolerance limits, can prevent the male terminal from entering the female terminal. In the alternative, if the misalignment between the respective terminals is not great, the insertion will cause the male terminal to rub against a respective side of the female terminal. This is unacceptable, particularly over a period of several cycles in which the terminals are inserted and removed. Over the span of several cycles even slight misalignment will cause uneven wear of the terminals, resulting in a failure of the electrical connection. The same problems arise if the terminals are bent.

The type of problems described above are particularly prevalent when connectors are inserted and removed many times over a period of time. The problem is magnified when blind mating of connectors is required. When blind mating occurs, the operator cannot see the terminals to insure their accurate alignment with respect to each other. Consequently, when blind mating occurs it is quite possible that male terminals will be stubbed on female terminal, causing male terminal to bend, which in turn causes the same problems described above.

Therefore, it is extremely beneficial to provide a connector which has terminals which can compensate for the misalignment and bending of the terminals of the mating connector. Such a connector insures that a positive electrical connection will be made each and every time insertion occurs.

SUMMARY OF THE INVENTION

An object of the present invention is to provide a connector with has movable terminals provided therein. The movable terminals can move relative to the housing of the connector, such that the movable terminals can compensate for the misalignment and bending of mating terminals of a mating connector. This insures that a repeatable positive electrical connection is insured between the terminals.

The invention is directed to an electrical connector for use with a mating electrical connector. The electrical connector comprises a first major surface and an oppositely facing second major surface. A connector mating surface is provided at one end of the connector and extends between the first and the second major surfaces. A wire receiving surface is provided at the opposite end of the connector and extends between the first and the second major surfaces. Connector openings are positioned in the connector and extend between the connector mating surface and the wire receiving surface.

The electrical connector is characterized in that terminals are positioned in the connector openings, the dimensions of the connector openings being greater than the dimensions of the terminals. The terminals have mounting means which cooperate with the walls of the connector openings to secure the terminals in the connector openings while allowing the terminals to move relative to the walls of the connector openings.

The mounting means the terminals of the electrical connector are comprised of terminal receiving housings. The terminal receiving housings have terminal receiving openings which extend between first ends and second ends of the terminal receiving housings. The terminal receiving housings have shoulder means provided thereon, the shoulder means cooperate with slots provided about the connector openings of the electrical connector to movably maintain the terminal receiving housings in the connector openings.

DETAILED DESCRIPTION OF THE INVENTION

Figure 1:
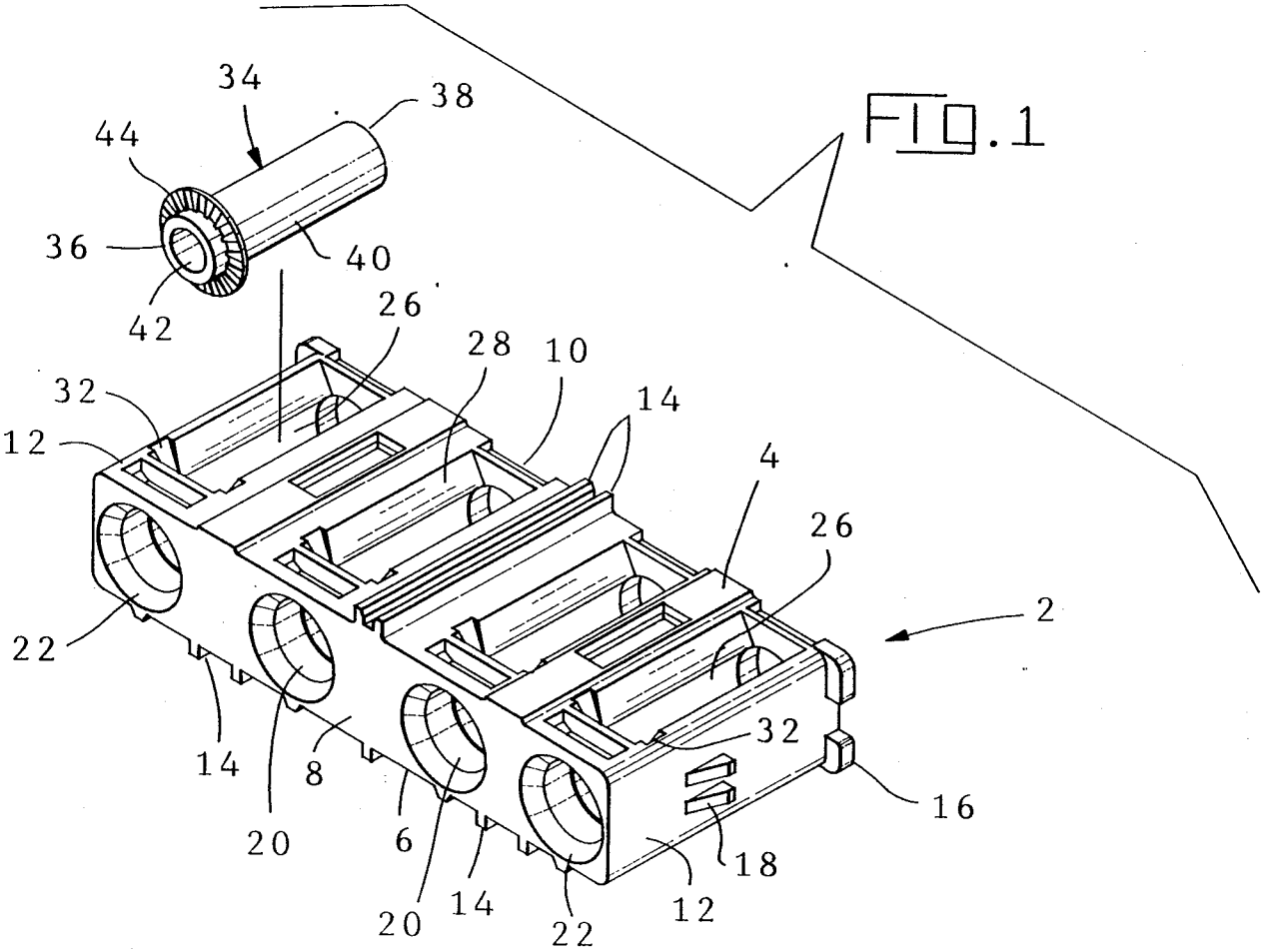
FIG. 1 is a perspective view of the connector housing of the present invention with a terminal receiving housing exploded therefrom.

Referring to FIG. 1, a connector housing 2 is shown. The connector housing is in the general shape of a rectangular box, having a first major surface 4, a second major surface 6, a front wall 8, a back wall 10, and side walls 12. Projections 14 are provided on first major surface 4 and second major surface 6. The projections provide the proper spacing and alignment between connectors when connector housings 2 is to be secured to other connectors or the like. Shoulders 16 and lances 18 are provided on side walls 12 to provide the means to secure the connector housings together as required. It should be noted that various configurations of projections 14, shoulders 16, and lances 18 can be provided and still provide the means necessary to insure the proper positioning of connector housing 2. In fact, any of the various projections listed above may be eliminated from connector housing 2, if they are not required.

Figures 2, 3:
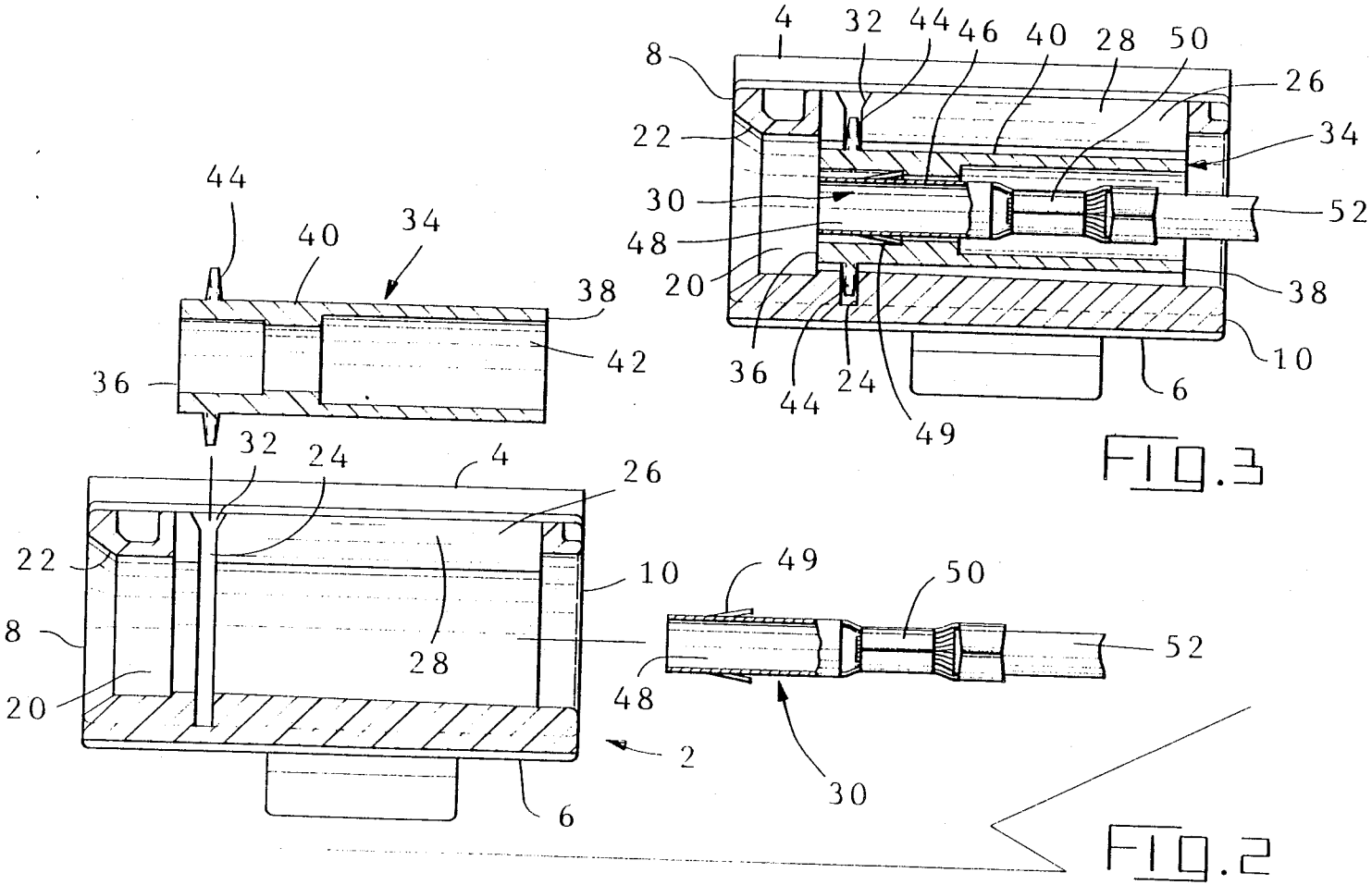
FIG. 2 is a cross-sectional view, taken along line 2—2 of FIG. 1, showing a terminal receiving housing prior to insertion into a respective opening of the connector housing.
FIG. 3 is a cross-sectional view similar to that of FIG. 2 showing the terminal receiving housing inserted into the connector housing.

As best shown in FIG. 2, apertures 20 are provided in connector housing 2, and extend from front wall 8 to back wall 10. Each aperture 20 has a lead-in surface 22 proximate front wall 8, the lead-in surface cooperates with a respective mating terminal 56, as will be described. Extending circumferentially about apertures 20 are slots 24 which extend into the walls of apertures 20. Slots 24 are positioned proximate lead-in surfaces 22.

Openings 26 are also provided on first major surface 4 of connector housing 2 and extend from proximate front wall 8 to proximate back wall 10. Openings 26 extend toward second major surface 6, intersecting apertures 20, thereby forming one continuous opening as is best shown in FIG. 1. Side walls 28 of openings 26 are tapered inward, to act as a lead-in surface as terminal receiving housings 34 are inserted therein. The configuration of side walls 28 provides a resilient characteristic, as will be more fully described below. Recesses 32 are provided in side walls 28, each recess 32 is positioned in alignment with a respective slot 24. Recesses 32 are tapered in essentially the same manner as side walls 28.

The number of openings 26 will be equal to the number of apertures 20 provided in connector housing 2. However, the number of openings 26 and apertures 20 provide in any particular connector housing will vary according to need.

A plurality of terminals 30 are positioned in connector housing 2, one terminal 30 for each aperture 20. As is shown FIG. 2, each terminal 30 is enclosed in a respective terminal housing 34. As is best shown in FIG. 1, terminal housings 34 are cylindrical in configuration, and made from any material having the structural and dielectric characteristics required. The size of each terminal housing 34 is slightly less than the size of the respective aperture 20 into which the terminal housing is inserted. As shown in FIG. 1, terminal housings 34 have front surfaces 36, rear surfaces 38 and cylindrical side surfaces 40. Terminal receiving openings 42 are provided in terminal housings 34, the openings extend from front surface 36 to rear surface 38. Ridges 44 are provided on side surfaces 40, the ridges extend outward from side surfaces 40. As is shown in FIGS. 2 and 3, shoulders 46 are also provided on side surfaces 40, the shoulders extend into openings 42 in order to cooperate with terminals 30, as will be discussed.

As is best shown in FIGS. 2 and 3, terminals 30 are made of metal or any other material having the required electrical characteristics. Terminals 30 have a pin receiving portion 48 and a wire receiving portion 50. It is only deemed necessary to provide a brief explanation of the terminals, as any of various well known terminals can be used with terminal housings 34. Terminals 30 are dimensioned to be received in terminal receiving openings 42 of terminal housing 34. Projecting outward from the surfaces of pin receiving portion 48 of terminals 30 are lances 49. Extending from wire receiving portion 50 and electrically engaged therewith is a wire 52. The electrical engagement is insured by the use of a crimp or some similar means.

Figure 4:
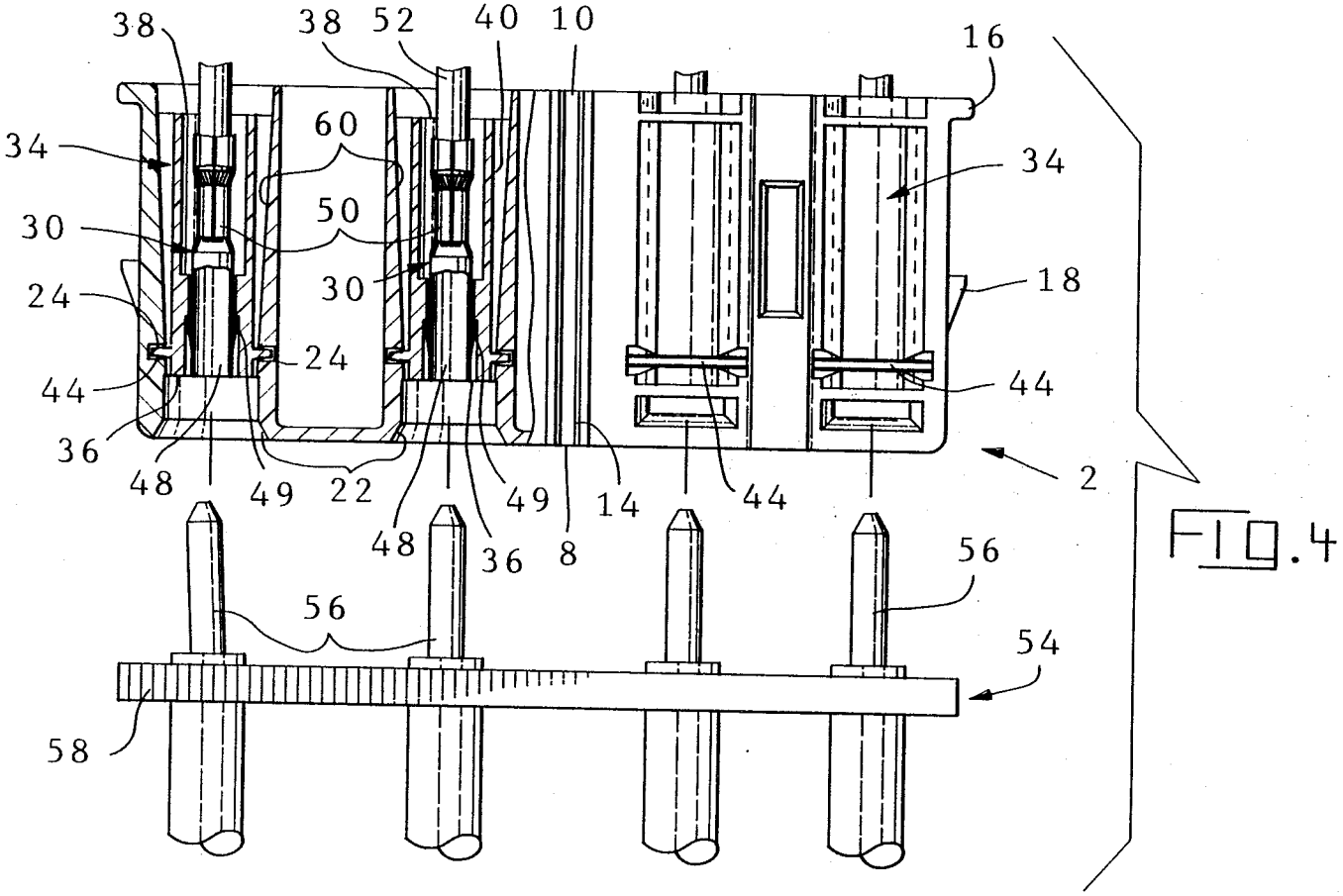
FIG. 4 is a top view of the connector housing prior to insertion onto a mating connector, the mating connector having a bent terminal, portions of the top wall and terminal receiving housing have been removed to show the terminals provided therein.

Mating connectors 54, as best shown in FIG. 4, are provided with pin contact terminals 56 extending therefrom. The pin contact terminals are positioned according to a housing or board 58 of some type. The number and alignment of contact terminals 56 generally corresponds to the number and alignment of terminals 30. Upon mating, pin contact terminals 56 are inserted into pin receiving portions 48 of terminals 30, as will be more fully described.

In order to facilitate the manufacture of connector housing 2, terminal receiving housings 34 are manufactured separately from connector housing 2. Assembly of the terminal housings into connector housing must therefore be accomplished.

The individual terminal housings 34 are inserted into apertures 20 of connector housing 2 through openings 26. As insertion occurs, ridges 44 of terminal housings 34 cooperate with recesses 32 of side walls 28 to properly align the terminal housings 34 in openings 26. The insertion of terminal housings 34 into openings 26 causes the resilient side walls 28 to move to a stressed position. As insertion continues, terminal housings 34 are moved past side walls 28 and ridges 44 are moved past recesses 32. This allows side walls 28 to return to an unstressed position, as shown in FIG. 1. In this unstressed position each side wall 28 cooperates with side surface 40 of a respective terminal housing 34 to maintain terminal housing 34 in aperture 20. Proper alignment of terminal housings 34 in apertures 20 is insured as ridges 44 are guided into slots 24 by recesses 32. Consequently, slots 24 maintain ridges 44, and therefore terminal housings 34 in position relative to connector housing 2.

Insertion of terminal housings 34 is complete when terminal housings 34 are inserted in apertures 20 and side walls 28 are returned to an unstressed position, as described above. In this unstressed position, side walls 28 cooperate with terminal housings 34 to prevent the terminal housings from being moved out of apertures 20, unless some special tool is used. As was also state above, ridges 44 are positioned in slots 24, such that ridges are restrained from any significant movement in the direction of the longitudinal axis of apertures 20. This restraint of ridges 44 insures that terminal housings 34 will be maintained in apertures 20. It should be noted that some movement of terminal housings 34 along the longitudinal axis does occur, due to the fact that the dimensions of slots 24 are greater than the dimensions of ridges 44.

Although terminal housings 34 are restrained in connector housing 2, the terminal housings 34 are permitted to move relative to connector housing 2. This movement is allowed due to the dimensions and configuration of apertures 20, slots 24, terminal housings 34, and ridges 44. As is shown in FIG. 4, the diameter of slots 24 is greater than the diameter of ridges 44. It is also important to note that the diameter of terminal housings 34 is less than the diameter of apertures 20. This allows the entire terminal housing 34 to moved in a direction which is perpendicular to the longitudinal axis of apertures 20. In other words, terminal housings 34 are capable of compensating for the misalignment of the mating connector 54 or any individual terminal 56 of that connector. Also as stated above, the width of slots 24 exceeds the width of ridges 44, thereby permitting some movement of terminal housings 34 along the longitudinal axis of apertures 20. The combination of these various dimensions also enables terminal housings 34 to effectively pivot about a point which is in the same plane as ridges 44.

The movement of terminal housings 34 in a direction which is perpendicular to the longitudinal axis of the apertures is an important feature of the connector. It is unrealistic to believe that each terminal 56 of mating connector 54 can be manufactured to be in precise alignment with each aperture 20 of connector housing 2. It is therefore important to allow connector housing 2 to have some means which can compensate for any slight misalignment of any or all mating terminals 56. (The term misalignment in this application refers to a terminal which is slightly offset from the exact centerline spacing which is preferred.) Consequently, by providing terminal housings 34 which are permitted to move in a direction which is perpendicular to the longitudinal axis of apertures 20, slight misalignment will not cause damage to terminals 30 as terminals 56 are inserted therein. The movement of the terminals 30 and terminals housings 34 provides the means to insure that a positive electrical connection is effected between terminals 30 and terminals 56.

In previous connectors, if any of the mating terminals had been slightly misaligned, the terminals of the connector would not have been able to compensate for this misalignment, as all parts of the connector and mating connector were prevented from movement. This misalignment would cause the mating terminal to engage only one side of the terminal, which would cause damage to the terminal due to the increase force applied to only one side thereof. This uneven contact created an unreliable electrical connection between the two terminals, as only one contact point was provided. Vibration or the like would cause inadequate force to be applied in the contact area, resulting in the failure of the electrical connection.

The type of damage and inadequate electrical connection described in the proceeding paragraph is essentially eliminated with the configuration of the connectors of the present invention. Allowing terminal housings 34 and terminals 30 to move relative to connector housing 2 allows a respective terminal 30 to compensate for the slight misalignment of a corresponding respective terminal 56. This compensation insures that the longitudinal axis of terminal 30 corresponds to the longitudinal axis of terminal 56. Consequently, as terminal 56 is inserted into terminal 30, terminal 56 will not engage either side of terminal 30 with undue force. Also, as the two axes correspond, terminal 56 will engage both sides of terminal 30 when terminal 56 is inserted therein, providing redundant contact points, thereby insuring that a positive electrical connection will be maintained.

The above described movement of terminal housings 34 and terminals 30 in a direction perpendicular to the longitudinal axis of apertures 20 adequately compensates for the slight misalignment of terminals 56 relative to terminals 30. However, if terminals 56 are bent, other problems occur. The movement of terminal housings 30 in a direction which is perpendicular to the longitudinal axis does not prevent the terminals from being damaged if terminals 56 are bent prior to insertion. Consequently, if no other means are provided for movement of terminal housings 34 relative to connector housing 2, the insertion of bent terminals 56 into terminals 30 will exert large forces on one side of terminals 30. This will result in damage to the terminals, which could result in the failure of the electrical connection.

Figure 5:
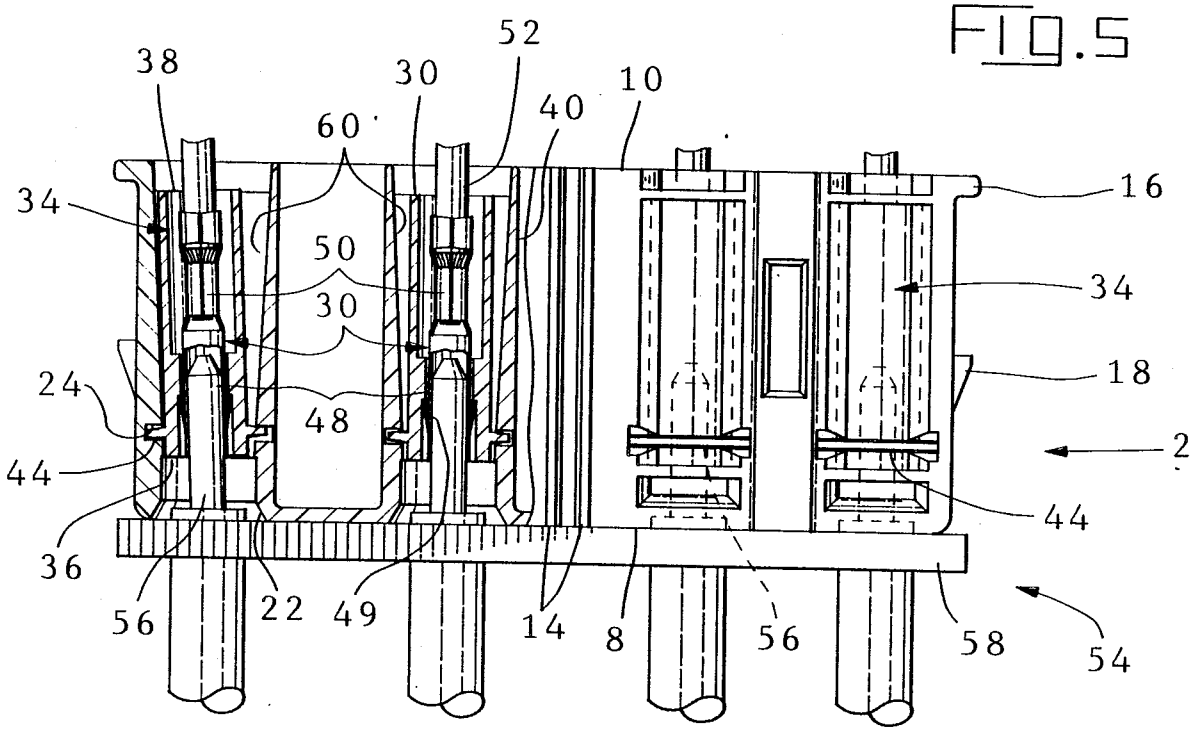
FIG. 5 is a top view similar to that of FIG. 4, showing the mating connector inserted into the connector housing.

In order to avoid damage to terminals 30 and to compensate for a slight bending of terminals 56, terminal housings 34 are configured to pivot about ridges 44. This type of motion is best illustrated in FIG. 5. As can be seen in the Figure, inside surfaces 60 of the side walls are sloped, such that the diameter of apertures 20 proximate rear walls 10 is greater than the diameter of apertures 20 proximate slots 24. This configuration provides the space required to allow terminal housings 34 to pivot about ridges 44, thereby allowing terminal housings 34 to compensate for bent terminal 56.

As is shown in FIGS. 4 and 5, the insertion of a bent terminal into a respective terminal housing 34 causes terminal housing 34 to pivot about ridges 44. Terminal housing 34 is pivoted in such a manner so as to essentially align the longitudinal axis of terminal housing 34 with the longitudinal axis of the bent portion of terminal 56. As bent terminal 56 is inserted into terminal housing 34, the end of bent terminal 56 engages a side of terminal 30. This causes terminal 30 and terminal housing 34 to pivot, as shown in FIG. 5. As insertion continues, terminal housing 34 is maintained in this pivoted position, thereby insuring that terminal 30 will not be damaged as terminal 56 is inserted therein.

These movable type of terminal housings are of great benefit, as the terminal housings can compensate for minor misalignment and bending of the terminals. Consequently, a much more stable and reliable electrical connection is effected. This type of configuration is extremely useful in applications in which blind mating occurs, i.e. when connector housing 2 is mated with mating connector 54 in an area of limited space, in which the terminals can not be seen as mating occurs.

It must also be remembered that many of these connectors are used over many cycles, i.e. connectors may be inserted and withdrawn many times. Consequently, in terminals which are made according to the teaching of the prior art, insertion of misaligned or bent mating terminals can damage terminals of the connector housing by merely exposing the terminals of the connector housing to unnecessary wiping action. The excessive wiping action, over a period of several cycles will be additive to prevent the terminals from functioning properly. In other words, the damage that is done to the terminals may not occur after only one insertion.

With movable terminal housings this cumulative effect is minimized and essentially eliminated. As the terminal housings are moved into alignment with the mating terminals, the insertion of the mating terminals into the terminals of the connector housing will produce no excessive wiping of either terminal. Consequently, the terminals will not be damaged after several cycles of insertions and removals have occurred.

Changes in construction will occur to those skilled in the art and various apparently different modifications and embodiments may be made without departing from the scope of the invention. The matter set forth in the foregoing description and accompanying drawings is offered by way of illustration only. It is therefore intended that the foregoing description be regarded as illustrative rather than limiting.

I claim:

1. An electrical connector for use with a mating electrical connector, the electrical connector comprising a first major surface and an oppositely facing second major surface, a connector mating surface is provided at one end of the connector and extends between the first and the second major surfaces, a wire receiving surface is provided at the opposite end of the connector and extends between the first and the second major surfaces, connector openings are positioned in the connector and extend between the connector mating surface and the wire receiving surface, the electrical connector being characterized in that:

terminals are positioned in the connector openings, the dimensions of the connector openings being greater than the dimensions of the terminals, the terminals have mounting means which cooperate with the walls of the connector openings to secure the terminals in the connector openings while allowing the terminals to move relative to the walls of the connector openings, channels are provided which extend from the first major surface of the electrical connector to the connector openings of the electrical connector, the channels being dimensioned to allow the mounting means to be inserted therethrough into the openings.

2. An electrical connector as set forth in claim 1 characterized in that the mounting means are comprised of terminal receiving housings.

3. An electrical connector as set forth in claim 2 characterized in that the channels have resilient side walls which are forced to move to a stressed position as the terminal housings are inserted through the channels, the side walls returning to their unstressed position once the terminal receiving housings are fully inserted into the connector openings, thereby preventing the terminal receiving housings from being removed from the openings without the use of a tool or the like.

4. An electrical connector as set forth in claim 2 characterized in that the terminals are inserted into the terminal receiving housings through the second ends of the terminal receiving housings, and are maintained in position by the cooperation of lances of the terminals with shoulders of inside side surfaces of the terminal receiving openings.

5. An electrical connector for use with a mating electrical connector, the electrical connector comprising a first major surface and an oppositely facing second major surface, a connector mating surface is provided at one end of the connector and extends between the first and the second major surfaces, a wire receiving surface is provided at the opposite end of the connector and extends between the first and the second major surfaces, connector openings are positioned in the connector and extend between the connector mating surface and the wire receiving surface, the electrical connector being characterized in that:

terminals are positioned in the connector openings, the dimensions of the connector openings being greater than the dimensions of the terminals, the terminals have terminal receiving housings which cooperate with the walls of the connector openings to secure the terminals in the connector openings while allowing the terminals to move relative to the walls of the connector openings, the terminal receiving housings have terminal receiving openings which extend between first ends and second ends of the terminal receiving housings, the terminal receiving housings have shoulder means provided thereon, the shoulder means cooperate with slots provided about the connector openings of the electrical connector to maintain the terminal receiving housings in the connector openings.

6. An electrical connector as set forth in claim 1 characterized in that the connector openings of the electrical connector have cylindrical configurations, with ends of the connector openings which are proximate the connector receiving surface having sloping side surfaces which act as lead-in surfaces when mating terminals are inserted therein.

7. An electrical connector as set forth in claim 1 characterized in that the terminals are inserted into the terminal receiving housings through the second ends of the terminal receiving housings, and are maintained in position by the cooperation of lances of the terminals with shoulders of inside side surfaces of the terminal receiving openings.

8. An electrical connector as set forth in claim 1 characterized in that the shoulder means are provided on outside surfaces of the terminal receiving housings proximate the first ends thereof, the first ends of the terminal receiving housings are provided proximate the connector receiving surface of the electrical connector.

9. An electrical connector as set forth in claim 8 characterized in that the shoulder means of the terminal receiving housings are ridges which extend circumferentially about the terminal receiving housings, the dimensions of the ridges being less than the dimensions of the slots with which they cooperate, allowing the ridges to move in relationship to the slots, thereby permitting the terminal receiving housings to move in a direction which is perpendicular to the longitudinal axis of the connector openings of the electrical connector, as well as allowing the terminal receiving housings to pivot about respective points which are in the same plane as the ridges of the terminal receiving housings, whereby as mating terminals are inserted into the terminal receiving housings, the terminal receiving housings can move relative to the electrical connector, thereby allowing the longitudinal axis of terminals to align with the longitudinal axis of the mating terminals when mating occurs, even if the mating terminals are misaligned or bent, thereby preventing damage to either the terminals or the mating terminals, and insuring that a positive electrical connection is effected.

10. An electrical connector as set forth in claim 1 characterized in that channels are provided which extend from the first major surface of the electrical connector to the connector openings of the electrical connector, the channels being dimensioned to allow the terminal receiving housings to be inserted therethrough into the openings.

11. An electrical connector as set forth in claim 10 characterized in that the channels have resilient side walls which are forced to move to a stressed position as the terminal housings are inserted through the channels, the side walls returning to their unstressed position once the terminal receiving housings are fully inserted into the connector openings, thereby preventing the terminal receiving housings from being removed from the openings without the use of a tool or the like.

* * * * *